US011257427B2

(12) United States Patent
Ling et al.

(10) Patent No.: US 11,257,427 B2
(45) Date of Patent: Feb. 22, 2022

(54) PIXEL CIRCUIT AND DRIVING METHOD THEREOF, DISPLAY SUBSTRATE AND DISPLAY APPARATUS

(71) Applicants: BOE Technology Group Co., Ltd., Beijing (CN); Hefei BOE Optoelectronics Technology Co., Ltd., Anhui (CN)

(72) Inventors: Jie Ling, Beijing (CN); Douqing Zhang, Beijing (CN); Wenjian Wang, Beijing (CN); Wei Cheng, Beijing (CN)

(73) Assignees: BOE Technology Group Co., Ltd., Beijing (CN); Hefei BOE Optoelectronics Technology Co., Ltd., Anhui (CN)

( * ) Notice: Subject to any disclaimer, the term of this patent is extended or adjusted under 35 U.S.C. 154(b) by 659 days.

(21) Appl. No.: 16/099,846

(22) PCT Filed: Apr. 13, 2018

(86) PCT No.: PCT/CN2018/082963
§ 371 (c)(1),
(2) Date: Nov. 8, 2018

(87) PCT Pub. No.: WO2019/041823
PCT Pub. Date: Mar. 7, 2019

(65) Prior Publication Data

US 2021/0225278 A1 Jul. 22, 2021

(30) Foreign Application Priority Data

Aug. 31, 2017 (CN) ..... 201710774035.4

(51) Int. Cl.
*G09G 3/3233* (2016.01)

(52) U.S. Cl.
CPC ... *G09G 3/3233* (2013.01); *G09G 2300/0842* (2013.01); *G09G 2320/0233* (2013.01)

(58) Field of Classification Search
CPC ..... G09G 3/3233; G09G 2300/0842; G09G 2320/0233
See application file for complete search history.

(56) References Cited

U.S. PATENT DOCUMENTS

2006/0066532 A1 3/2006 Jeong
2006/0103322 A1 5/2006 Chung et al.
(Continued)

FOREIGN PATENT DOCUMENTS

CN 1776794 A 5/2006
CN 101866614 A 10/2010
(Continued)

OTHER PUBLICATIONS

Jun. 21, 2018—(WO) International Search Report and Written Opinion application PCT/CN2018/082963 with English Translation.

*Primary Examiner* — Stacy Khoo
(74) *Attorney, Agent, or Firm* — Banner & Witcoff, Ltd.

(57) ABSTRACT

A pixel circuit and driving method thereof, a display substrate and a display device are disclosed. The pixel circuit includes a light-emitting element, a drive element, a first switch element, a reset circuit and a compensating circuit. The drive element is connected to the light-emitting element and configured to drive the light-emitting element to emit light; the first switch circuit is configured to apply a data voltage to the drive element under control of a scan signal; the reset circuit is electrically connected to the compensating circuit, and configured to apply a reset signal to the compensating circuit under control of the scan signal; the compensating circuit is configured to compensate the drive element, so as to allow a signal output from the drive
(Continued)

element to be relevant with the data voltage and the reset voltage and to be irrelative to threshold characteristic of the drive element.

11 Claims, 6 Drawing Sheets

(56) References Cited

U.S. PATENT DOCUMENTS

| | | | |
|---|---|---|---|
| 2010/0265166 | A1 | 10/2010 | Kang et al. |
| 2014/0152191 | A1 | 6/2014 | Yang et al. |
| 2015/0371586 | A1 | 12/2015 | Chen et al. |
| 2017/0069263 | A1 | 3/2017 | Hu |
| 2018/0374417 | A1 | 12/2018 | Yang et al. |

FOREIGN PATENT DOCUMENTS

| | | | |
|---|---|---|---|
| CN | 102930821 | A | 2/2013 |
| CN | 103021331 | A | 4/2013 |
| CN | 104064146 | A | 9/2014 |
| CN | 104157241 | A | 11/2014 |
| CN | 104409047 | A | 3/2015 |
| CN | 106486063 | A | 3/2017 |
| CN | 107393470 | A | 11/2017 |
| CN | 207217080 | U | 4/2018 |

PIXEL CIRCUIT AND DRIVING METHOD THEREOF, DISPLAY SUBSTRATE AND DISPLAY APPARATUS

The application is a U.S. National Phase Entry of International Application No. PCT/CN2018/082963 filed on Apr. 13, 2018, designating the United States of America and claiming priority to Chinese Patent Application No. 201710774035.4, filed on Aug. 31, 2017. The present application claims priority to and the benefit of the above-identified applications and the above-identified applications are incorporated by reference herein in their entirety.

TECHNICAL FIELD

Embodiments of the present disclosure relate to a pixel circuit and a driving method thereof, a display substrate and a display device.

BACKGROUND

Organic Light Emitting Diode (OLED) display devices have traits of wide viewing angle, high contrast, fast response speed and so on. Moreover, as compared with inorganic light emitting display devices, the organic light emitting diode display devices have a higher luminance, a lower driving voltage and other advantages. In virtue of possessing the above-mentioned traits and advantages, the organic light emitting diode (OLED) display devices have gradually attracted wide attentions of people, and can be suitable for mobile phones, displays, notebook computers, digital cameras, instruments and meters and other apparatuses having a display function.

SUMMARY

At least one embodiment of the present disclosure provides a pixel circuit, and the pixel circuit comprises a light-emitting element, a drive element, a first switch element, a reset circuit and a compensating circuit. The drive element is connected to the light-emitting element and configured to drive the light-emitting element to emit light; the first switch circuit is configured to apply a data voltage to the drive element under control of a scan signal; the reset circuit is connected to the compensating circuit, and configured to apply a reset signal to the compensating circuit under control of the scan signal; the compensating circuit is configured to compensate the drive element, so as to allow a signal output from the drive element to be irrelative to threshold characteristic of the drive element.

For example, in the pixel circuit provided by at least one embodiment of the present disclosure, the data voltage is applied to the control terminal of the drive element, the reset signal is a reset voltage; the signal output from the drive element is a drive current; and the compensating circuit is further configured to allow the signal output from the drive element to be relevant with the data voltage and the reset signal.

For example, the pixel circuit provided by at least one embodiment of the present disclosure further comprising a control circuit, the control circuit is connected to the drive element and the compensating circuit, and configured to apply a drive signal to the drive element and the compensating circuit based on a control signal.

For example, the pixel circuit provided by at least one embodiment of the present disclosure further comprising a first node, a second node and a third node, the control circuit comprises a first transistor; a control terminal of the first transistor is configured to receive the control signal; a first terminal of the first transistor is configured to receive the drive signal; and a second terminal of the first transistor is connected to the third node.

For example, in the pixel circuit provided by at least one embodiment of the present disclosure, the compensating circuit comprises a storage capacitor and a second switch circuit; and the second switch circuit is configured to control whether or not the storage capacitor is connected to a control terminal of the drive element based on a second scan signal.

For example, in the pixel circuit provided by at least one embodiment of the present disclosure, a first end of the storage capacitor is connected to the second node, and a second end of the storage capacitor is connected to the third node; and the second switch circuit comprises a third transistor, a control terminal of the third transistor is configured to receive the second scan signal, a first terminal of the third transistor is connected to the second node, and a second terminal of the third transistor is connected to the first node.

For example, in the pixel circuit provided by at least one embodiment of the present disclosure, the reset circuit comprises a second transistor; a control terminal of the second transistor is configured to receive the scan signal; a first terminal of the second transistor is configured to receive the reset signal; and a second terminal of the second transistor is connected to the second node.

For example, in the pixel circuit provided by at least one embodiment of the present disclosure, the first switch circuit comprises a fourth transistor, a control terminal of the fourth transistor is configured to receive the scan signal, a first terminal of the fourth transistor is configured to receive the data voltage, and a second terminal of the fourth transistor is connected to the first node; and the drive element comprises a fifth transistor, a control terminal of the fifth transistor is configured to be the control terminal of the drive element, and configured to be connected to the first node, the data voltage is applied to the control terminal of the drive element; a first terminal of the fifth transistor is connected to the third node, and a second terminal of the fifth transistor is connected to a first terminal of the light-emitting element.

For example, in the pixel circuit provided by at least one embodiment of the present disclosure, the light-emitting element is an organic light-emitting element, and a second terminal of the light-emitting element is connected to a second power supply terminal.

For example, in the pixel circuit provided by at least one embodiment of the present disclosure, the first transistor, the third transistor and the fifth transistor are P-type transistors.

For example, in the pixel circuit provided by at least one embodiment of the present disclosure, the second transistor and the fourth transistor are N-type transistors; and the control terminals of the second transistor, the third transistor and the fourth transistor are connected to same one scan control terminal.

For example, the pixel circuit provided by at least one embodiment of the present disclosure further comprising a phase inverter. The phase inverter is arranged between the control terminal of the third transistor and a scan control terminal; the second transistor and the fourth transistor are P-type transistors; and the control terminals of the second transistor, the third transistor and the fourth transistor are connected to same one scan control terminal.

At least one embodiment of the present disclosure further provides a display substrate, and the display substrate comprises the pixel circuit provided by any one of the embodiments of the present disclosure.

At least one embodiment of the present disclosure further provides a display device, and the display device comprises the pixel circuit or the display substrate provided by any one of the embodiments of the present disclosure.

At least one embodiment of the present disclosure further provides a driving method of a pixel circuit, the driving method comprises: compensating the drive element with the compensating circuit during a threshold compensating stage; and outputting a signal by the drive element so as to drive the light-emitting element to emit light during a display stage, in which the signal output from the drive element is irrelative to the threshold characteristic of the drive element.

For example, the driving method provided by at least one embodiment of the present disclosure further comprises: applying the data voltage to the drive element, and applying the reset signal to the compensating circuit by the reset circuit, during a reset stage.

BRIEF DESCRIPTION OF THE DRAWINGS

In order to clearly illustrate the technical solution of the embodiments of the disclosure, the drawings of the embodiments will be briefly described in the following; it is obvious that the described drawings are only relevant with some embodiments of the disclosure and thus are not limitative of the disclosure.

DETAILED DESCRIPTION

In order to allow objects, technical details and advantages of the embodiments of the disclosure apparent, the technical solutions of the embodiments will be described in a clearly and fully understandable way in connection with the drawings relevant with the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Pixel circuits in an OLED display device generally adopt a matrix drive mode, which is classified into Active Matrix (AM) drive mode and Passive Matrix (PM) drive mode according to whether or not a switching component is introduced into each pixel unit. As regards AMOLEDs, a set of thin film transistors and a storage capacitor are integrated into the pixel circuit of each pixel, and by means of drive control of the thin film transistors and the storage capacitor, the control of the current flowing through OLEDs is realized, thereby allowing OLEDs to emit light as required.

Figure 1A:
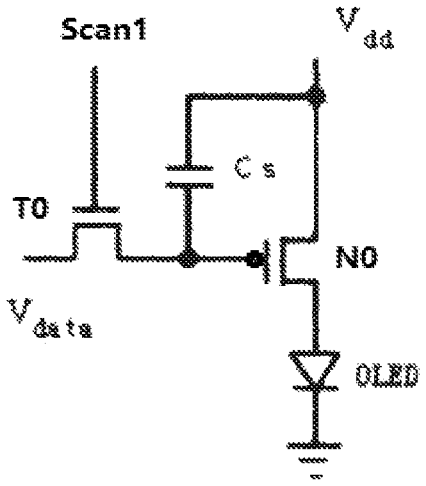
FIG. 1A is a schematic view illustrating a 2T1C pixel circuit.
Figure 1B:
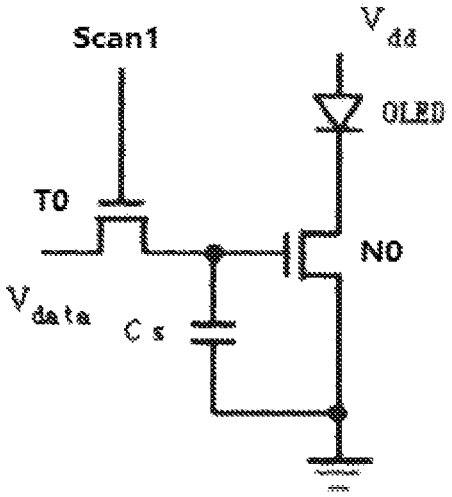
FIG. 1B is a schematic view illustrating another 2T1C pixel circuit.

Basic pixel circuits used in AMOLED display devices are usually 2T1C pixel circuits, namely, two Thin-film transistors (TFTs) and one storage capacitor Cs are utilized to drive an OLED to emit light. FIG. 1A and FIG. 1B are schematic views illustrating two 2T1C pixel circuits.

As illustrated in FIG. 1A, a 2T1C pixel circuit includes a switch transistor T0, a drive transistor N0 and a storage capacitor Cs. For example, a gate electrode of the switch transistor T0 is connected to a scan line so as to receive a scan signal Scan1; for example, a source electrode of the switch transistor T0 is connected to a data line so as to receive a data signal Vdata, a drain electrode of the switch transistor T0 is connected to a gate electrode of the drive transistor No; a source electrode of the drive transistor N0 is connected to a first voltage terminal to receive a first voltage Vdd (high voltage); a drain electrode of the drive transistor N0 is connected to a positive terminal (anode) of an OLED; an end of the storage capacitor Cs is connected to the drain electrode of the switch transistor T0 and the gate electrode of the drive transistor N0, another end of the storage capacitor Cs is connected to the source electrode of the drive transistor N0 and the first voltage terminal; a negative terminal (cathode) of the OLED is connected to a second voltage terminal so as to receive a second voltage Vss (low voltage, e.g., grounding voltage). Two TFTs and a storage capacitor Cs are used in the 2T1C pixel circuit to control the brightness of pixel (grayscale). When the scan signal Scan1 is applied by the scan line to turn on the switch transistor T0, the data signal Vdata delivered by a data drive circuit via the data line can charge the storage capacitor Cs via the switch transistor T0, and thus the data signal Vdata is stored in the storage capacitor Cs; and furthermore, the data signal Vdata stored in the storage capacitor Cs controls the conductive degree of the drive transistor N0, and thus controls the intensity of the current that flows through the drive transistor and drives the OLED to emit light. Namely, the illuminant grayscale of the pixel is determined by the current. In the 2T1C pixel circuit as illustrated in FIG. 1A, the switch transistor T0 is an N-type transistor and the drive transistor N0 is a P-type transistor.

As illustrated in FIG. 1B, another 2T1C pixel circuit also includes a switch transistor T0, a drive transistor N0 and a storage capacitor Cs, but its connections has a slight change, and the drive transistor N0 is an N-type transistor. The differences of the pixel circuit of FIG. 1B with respect to FIG. 1A includes that, a positive terminal of an OLED is connected to a first voltage terminal so as to receive a first voltage Vdd (high voltage), while a negative terminal of the OLED is connected to a drain electrode of a drive transistor N0, a source electrode of the drive transistor N0 is connected to a second voltage terminal so as to receive a second voltage Vss (low voltage, e.g., grounding voltage). One end of the storage capacitor Cs is connected to a drain electrode of the switch transistor T0 and a gate electrode of the drive transistor N0, and the other end of the storage capacitor Cs is connected to the source electrode of the drive transistor N0 and the second voltage terminal. The operation mode of the 2T1C pixel circuit as illustrated in FIG. 1B is substantially the same as that of the pixel circuit as illustrated in FIG. 1A, and no further description will be given here.

In addition, regarding the pixel circuits as illustrated in FIG. 1A and FIG. 1B, the switch transistor T0 is not limited to N-type transistors, and may also be P-type transistors, and in this case, the polarity of the scan signal that is provided by the scan control terminal Scan1 to control the turn-on or turn-off of the switch transistor T0 can be changed accordingly.

The OLED display device usually includes a plurality of pixel units arranged in arrays, and each of the pixel units may, for example, include the above-mentioned pixel circuit. In the OLED display device, the threshold voltage of the drive transistor in each pixel circuit may vary from each other owing to manufacturing process. Further, due to the influence of temperature variation, a drift phenomenon may occur to the threshold voltage of the drive transistor. Consequently, the differences between the voltage thresholds of the drive transistors can lead to display defects (e.g., display inhomogeneous), and therefore it is necessary to conduct threshold voltage compensation. Moreover, because the existence of leakage current in the turn-off state, the display defects can be resulted as well.

It is noticed by the inventors of the present disclosure that, as compared to a voltage drive type display device, a current drive type display device is more susceptible to the threshold characteristic of transistors in the display device, and therefore a phenomenon of uneven brightness exists in the display device can be caused.

The embodiments of the present disclosure provide a pixel circuit and a driving method thereof, a display substrate and a display device. With respect to the pixel circuit and the driving method thereof, the display substrate and the display device, threshold compensation is realized, and therefore, the uniformity of the brightness of the display substrate and the display device including the pixel circuit is promoted.

It is to be noted that, for the sake of clarity, the embodiments of the present disclosure are concretely described with reference to the example in which a reset voltage, a drive voltage and a drive current respectively act as a reset signal, a drive signal and the signal output from a drive element, but the embodiments of the present disclosure are not limited to this case.

At least one embodiment of the present disclosure provides a pixel circuit, and the pixel circuit comprises a light-emitting element, a drive element, a first switch element, a reset circuit and a compensating circuit. The drive element is connected to the light-emitting element and configured to drive the light-emitting element to emit light; the first switch circuit is configured to apply a data voltage to the drive element under control of a scan signal; the reset circuit is connected to the compensating circuit, and configured to apply a reset signal to the compensating circuit under control of the scan signal; the compensating circuit is configured to compensate the drive element, so as to allow a signal output from the drive element to be irrelative to threshold characteristic of the drive element.

Non-limitive descriptions are given to the pixel circuit provided by the examples of the present disclosure in the following with reference to a plurality of examples. As described in the following, in case of no conflict, different features in these specific examples may be combined so as to obtain new examples, and the new examples are also fall within the scope of present disclosure.

An embodiment of the present disclosure provides a pixel circuit 100, which can be used in a display substrate and a display device. For example, FIG. 2A is a schematic block diagram illustrating the pixel circuit 100 provided by an embodiment of the present disclosure, and as illustrated in FIG. 2A, the pixel circuit 100 may include a light-emitting element 110, a drive element 120, a first switch circuit 130, a reset circuit 140 and a compensating circuit 150.

For example, the drive element 120 is electrically connected to the light-emitting element 110 and configured to output a drive current for driving the light-emitting element 110 to emit light. For example, the first switch circuit 130 is configured to apply a data voltage to the control terminal of the drive element 120 under control of a scan signal. For example, the reset circuit 140 is electrically connected to the compensating circuit 150, and configured to apply a reset voltage to the compensating circuit 150 based on the scan signal, so as to reset the compensating circuit 150. For example, the compensating circuit 150 is configured to compensate the drive element 120, so as to allow the drive current of the drive element 120 to be relevant with the data voltage and the reset voltage while to be irrelative to the threshold voltage of the drive element 120.

Figure 2A:
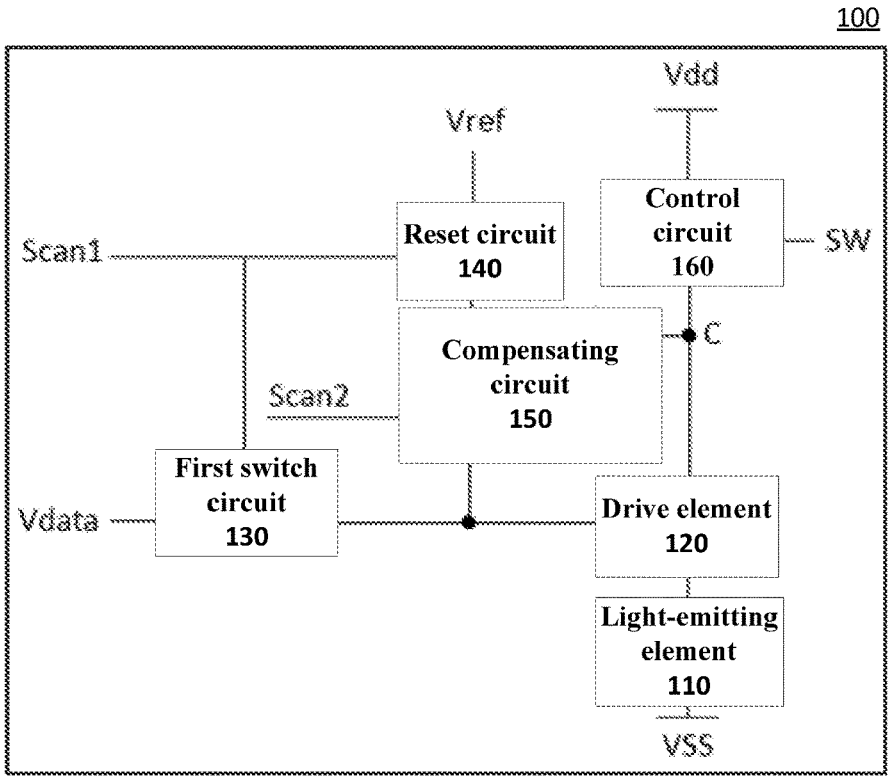
FIG. 2A is a schematically block diagram illustrating a pixel circuit provided by an embodiment of the present disclosure.

For example, as illustrated in FIG. 2A, according to actual application requirements, the pixel circuit 100 may further include a control circuit 160. For example, the control circuit 160 may be connected to the drive element 120 and the compensating circuit 150, and may be configured to control whether or not a drive voltage V_dd is applied to the drive element 120 and the compensating circuit 150 based on a control signal.

For example, specific implementations of the light-emitting element 110, the drive element 120, the first switch circuit 130, the reset circuit 140, the compensating circuit 150 and the control circuit 160 may be set according to actual application requirements, and no specific limitation will be given to the embodiment of the present disclosure in this respect. For example, the pixel circuit 100 provided by an embodiment of the present disclosure may be implemented as the circuit diagram as illustrated in FIG. 2B.

Figure 2B:
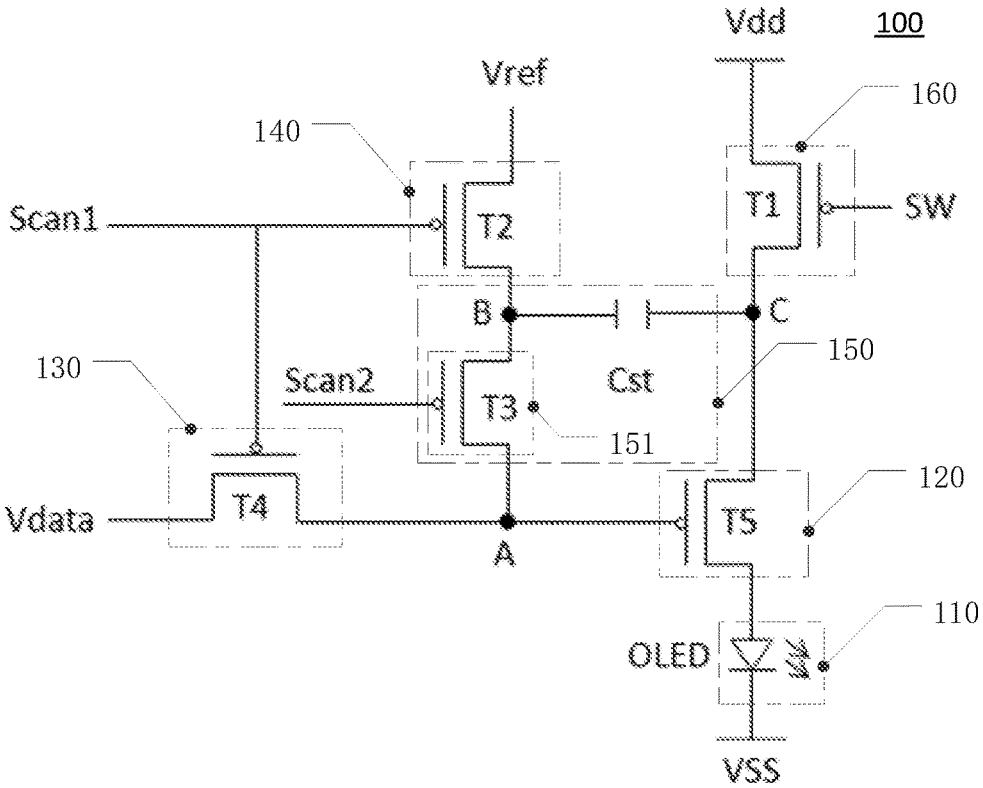
FIG. 2B is an exemplary circuit diagram illustrating the pixel circuit as illustrated in FIG. 2A.

For example, as illustrated in FIG. 2B, the pixel circuit 100 may further include a first node A, a second node B and a third node C. For example, the first node A, the second node B and the third node C are merely used to describe connecting relationship between various elements, and it is not necessary to arrange, for example, welding spots or solder pads in the pixel circuit 100 to function as specific nodes.

For example, as illustrated in FIG. 2B, the light-emitting element 110 may be an organic light-emitting element, which may be, for example, an organic light emitting diode (OLED), but the embodiment of the present disclosure is not limited to this case. For example, a second terminal (cathode terminal) of the light-emitting element 110 is electrically connected to a second power supply terminal Vss; the second power supply terminal Vss may be, for example, a grounding terminal, or be a common low-voltage terminal, but the embodiment of the present disclosure is not limited thereto.

For example, as illustrated in FIG. 2B, the drive element 120 may include a fifth transistor T5. For example, the first terminal of the fifth transistor T5 is electrically connected to the third node C. For example, the second terminal of the fifth transistor T5 may be electrically connected to a first terminal (anode terminal) of the light-emitting element 110, but the embodiment of the present disclosure is not limited thereto. For example, the control terminal of the fifth transistor T5 is configured as the control terminal of the drive element 120, and configured to be connected to the first node A. For example, in the case where the fifth transistor T5 is turned on, the drive current output from the fifth transistor T5 can be provided to the light-emitting element 110, and therefore, the drive element 110 can be driven to emit light. For example, the fifth transistor T5 may be a P-type transistor, but the embodiment of the present disclosure is not limited thereto.

For example, as illustrated in FIG. 2B, the first switch circuit 130 may include a fourth transistor T4. For example, the first terminal of the fourth transistor T4 is electrically connected to a data source terminal Vdata, so as to receive a data voltage V_data; the second terminal of the fourth transistor T4 is electrically connected to the first node A. For example, the control terminal of the fourth transistor T4 may be configured to receive the scan signal. For example, in the case where the scan signal received by the control terminal of the fourth transistor T4 is an on-signal (e.g., signal with low voltage level), the first terminal of the fourth transistor T4 can be electrically connected to the second terminal of the fourth transistor T4, and thus the data voltage V_data output from the data source terminal Vdata can be loaded to the first node A and the control terminal of the fifth transistor T5.

For example, as illustrated in FIG. 2B, the reset circuit 140 may include a second transistor T2. For example, the first terminal of the second transistor T2 is electrically connected to a reset power terminal Vref, so as to receive a reset voltage V_ref, which may be, for example, a constant positive voltage; the second terminal of the second transistor T2 is electrically connected to the second node B. For example, the control terminal of the second transistor T2 is configured to receive the scan signal. For example, in the case where the scan signal received by the control terminal of the second transistor T2 is an on-signal (e.g., signal with low voltage level), the first terminal of the second transistor T2 can be electrically connected to the second terminal of the second transistor T2. In this way, the reset voltage V_ref output from the reset power terminal Vref can be applied to the second node B and the compensating circuit 150, and therefore, the compensating circuit 150 can be reset.

For example, the second transistor T2 and the fourth transistor T4 may be in a turned-on state simultaneously or in a turn-off state simultaneously. For example, each of the second transistor T2 and the fourth transistor T4 may be a P-type transistor, and in this case, the control terminals of the second transistor T2 and the fourth transistor T4 may be connected to same one scan control terminal Scan1, and may receive same one scan signal. Consequently, the pixel circuit 100 can be simplified. However, the embodiment of the present disclosure is not limited to this case.

For example, as illustrated in FIG. 2B, the compensating circuit 150 may include a storage capacitor Cst and a second switch circuit 151. For example, the second switch element 151 may be configured to control whether or not the storage capacitor Cst is electrically connected to the control terminal of the drive element 120 based on a second scan signal. For example, as illustrated in FIG. 2B, the first terminal of the storage capacitor Cst is electrically connected to the second node B, and the second terminal of the storage capacitor Cst is electrically connected to the third node C.

For example, as illustrated in FIG. 2B, the second switch circuit 151 includes a third transistor T3. For example, the first terminal of the third transistor T3 is electrically connected to the second node B, and the second terminal of the third transistor T3 is electrically connected to the first node A. For example, the control terminal of the third transistor T3 is configured to receive the second scan signal; for example, in the case where the second scan signal received by the control terminal of the third transistor T3 is an on-signal (e.g., signal with low voltage level), the first terminal of the third transistor T3 can be electrically connected to the second terminal of the third transistor T3, and consequently, this enables the voltage at the first node A to be equal to the voltage at the second node B. Namely, whether or not the second node B, which is electrically connected to the storage capacitor Cst, is electrically connected to the control terminal of the drive element 120, which is electrically connected to the first node A, can be controlled based on the second scan signal.

For example, the third transistor T3 may be in a state opposite to that of the second transistor T2 and the fourth transistor T4 (for example, in the case where the third transistor T3 is in a turn-off state, the second transistor T2 and the fourth transistor T4 are in a turned-on state). For example, the third transistor T3 may be a P-type transistor, and in the case where the second transistor T2 and the fourth transistor T4 are also P-type transistors, the control terminal of the third transistor T3 may be connected to a second scan control terminal Scan2. In this way, the second scan signal that is provided by the second scan control terminal Scan2 and received by the control terminal of the third transistor T3 can be inverted in phase with respect to the scan signal that is provided by the scan control terminal Scan1 and received by the control terminal of the second transistor T2 and the control terminal of the fourth transistor T4 (for example, in the case where the second scan signal received by the control terminal of the third transistor T3 is a signal with high voltage level, the scan signal received by the control terminal of the second transistor T2 and the control terminal of the fourth transistor T4 may be a signal with low voltage level). However, the embodiment of the present disclosure is not limited to this case.

For example, as illustrated in FIG. 2B, the control circuit 160 may include a first transistor T1. For example, the first terminal of the first transistor T1 is electrically connected to a first power supply terminal Vdd, so as to receive the drive voltage V_dd, which may be, for example, a constant positive voltage. For example, the voltage output from the first power supply terminal Vdd may be greater than the voltage output from the second power supply terminal Vss. For example, the second terminal of the first transistor T1 is electrically connected to the third node C. For example, the control terminal of the first transistor T1 is configured to receive the control signal; for example, the pixel circuit 100 may further include a drive voltage control terminal SW which is configured to provide the control signal. The control terminal of the first transistor T1 may be electrically connected to the drive voltage control terminal SW, and thereby the control terminal of the first transistor T1 is enabled to receive the control signal. For example, in the case where the control signal received by the control terminal of the first transistor T1 is an on-signal (signal with low voltage level), the first terminal of the first transistor T1 can be electrically connected to the second terminal of the first transistor T1, and thus the drive voltage V_dd output from the first power supply terminal Vdd can be loaded to the third node C (i.e., the drive circuit 120 and the compensating circuit 150). For example, the first transistor T1 may be a P-type transistor, but the embodiment of the present disclosure is not limited thereto.

Figure 2C:
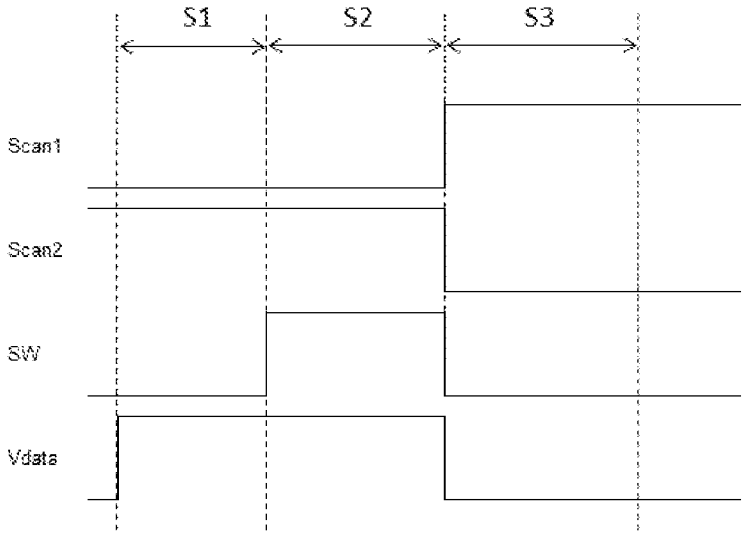
FIG. 2C is an exemplary diagram illustrating drive timing of the pixel circuit as illustrated in FIG. 2B.

For example, an exemplary operation of the pixel circuit 100 provided by an embodiment of the present disclosure will be specifically described below by taking the pixel circuit 100 as illustrated in FIG. 2B as an example. For example, FIG. 2C is an exemplary drive timing diagram of the pixel circuit 100 as illustrated in FIG. 2B. For example, for the pixel circuit 100 as illustrated in FIG. 2B, compensation function can be realized by the following steps, and therefore, the drive current of the drive element 120 can be relevant to the data voltage and the reset voltage and irrelative to the threshold voltage of the drive element 120.

Step S110, at a reset stage S1, the first transistor T1, the second transistor T2 and the fourth transistor T4 are turned on, and the third transistor T3 is turned off.

Step S120, at a threshold compensating stage S2, the second transistor T2 and the fourth transistor T4 are turned on, and the first transistor T1 and the third transistor T3 are turned off.

Step S130, at a display stage S3, the first transistor T1 and the third transistor T3 are turned on, and the second transistor T2 and the fourth transistor T4 are turned off.

For example, as illustrated in FIG. 2B and FIG. 2C, in the step S110, namely at the reset stage S1, an on-signal (e.g., signal with low voltage level) can be applied to control terminals of the first transistor T1, the second transistor T2 and the fourth transistor T4 and a turn-off signal (e.g., signal with high voltage level) can be applied to the control terminal of the third transistor T3, namely, a signal with low voltage level is provided to the drive voltage control terminal SW and the scan control terminal Scan1, and a signal with high voltage level is provided to the second scan control terminal Scan2, so that the first transistor T1, the second transistor T2 and the fourth transistor T4 can be turned on, and the third transistor T3 can be turned off. In the above-mentioned case, the data voltage V_data provided by the data source terminal Vdata can be applied to the first node A and the control terminal of the fifth transistor T5, the reset voltage V_ref provided by the reset power terminal Vref is applied to the second node B and the first end of the storage capacitor Cst, and the drive voltage V_dd provided by the first power supply terminal Vdd is applied to the third node C, the first terminal of the fifth transistor T5 and the second end of the storage capacitor Cst. In this way, the voltage V_A of the first node A, the voltage V_B of the second node B and the voltage V_C of the third node C satisfy the following expressions respectively: V_A=V_data; V_B=V_ref; V_C=V_dd.

For example, as illustrated in FIG. 2C, at the reset stage S1, the data signal V_data provided by the data source terminal Vdata is a positive voltage. It is to be noted that, for the reset stages S1 of different display periods (for example, each of the display periods may include a reset stage S1, a threshold compensating stage S2 and a display stage S3), the values of the data voltages V_data provided by the data source terminal Vdata may be different from each other, and thus different grayscales can be displayed at different display periods according to actual application requirements.

For example, as illustrated in FIG. 2B and FIG. 2C, in the step S120, namely at the threshold compensating stage S2, a signal (e.g., signal with low voltage level) can be applied to the control terminals of the second transistor T2 and the fourth transistor T4 so as to turn on the second transistor T2 and the fourth transistor T4, and a signal (e.g., signal with high voltage level) can be applied to the control terminals of the first transistor T1 and the third transistor T3 so as to turned off the first transistor T1 and the third transistor T3. That is, the scan control terminal Scan1 provides a signal with low voltage level and the drive voltage control terminal SW and the second scan control terminal Scan2 provide a signal with high voltage levels, so as to turn on the second transistor T2 and the fourth transistor T4, and to turned off the first transistor T1 and the third transistor T3.

For example, at the threshold compensating stage S2, the voltage at the control terminal of the fifth transistor T5 and the first node A is V_A=V_data; at an initial phase of the threshold compensating stage S2, the voltage at the first terminal of the fifth transistor T5 and the third node C is V_C=V_dd. For example, as for a P-type transistor, difference between the drive voltage V_dd and the data voltage V_data can be usually far greater than the absolute value |Vth| of the threshold voltage of the fifth transistor T5 (the value of the drive voltage V_dd is usually greater than 15V, and the value of the data voltage V_data is usually less than 5V), and therefore, the fifth transistor T5 will be turned on at the threshold compensating stage S2 and electric charges are discharged, until the voltage at the third node C and the first terminal of the fifth transistor T5 is reduced to be such a value that allows the fifth transistor T5 to be turned off.

For example, in the case where the fifth transistor T5 is a P-type transistor, the threshold voltage of the fifth transistor T5 is negative, and the expression of allowing the fifth transistor T5 to be turned on satisfies |V_A−V_C|>|Vth|, namely, V_C−V_A>|Vth|. Therefore, in the case where the voltage at the third node C and the first terminal of the fifth transistor T5 is reduced to be V_C=V_data+|Vth|, the fifth transistor T5 is turned off, and the voltage V_A at the first node A, the voltage V_B at the second node B and the voltage V_C at the third node C satisfy the following expressions respectively: V_A=V_data; V_B=V_ref; V_C=V_data+|Vth|. As can be deduced from the above-mentioned expressions, the voltage difference between the third node C and the second node B is V_C−V_B=V_data+|Vth|−V_ref.

For example, as illustrated in the figure, at the threshold compensating stage S2, the data voltage V_data, which is provided by the data source terminal Vdata, can be a positive voltage. For example, at the threshold compensating stage S2, the positive voltage provided by the data source terminal Vdata may be equal to a positive voltage provided at the reset stage S1 of the same display period. It is to be noted that, for the threshold compensating stage S2 of different display periods, the values of the positive voltages provided by the data source terminal Vdata may be different from each other, so as to display different grayscales at different display periods according to actual application requirements.

For example, as illustrated in FIG. 2B and FIG. 2C, in the step S130, namely at the display stage S3, a signal (e.g., signal with low voltage level) can be applied to the control terminals of the first transistor T1 and the third transistor T3 so as to turn on the first transistor T1 and the third transistor T3, and a signal (e.g., signal with high voltage level) can be applied to the control terminals of the second transistor T2 and the fourth transistor T4 so as to turned off the second transistor T2 and the fourth transistor T4. That is, the scan control terminal Scan1 provides a signal with high voltage level and the drive voltage control terminal SW and the second scan control terminal Scan2 provide a signal with low voltage levels, so as to turn on the first transistor T1 and the third transistor T3, and to turned off the second transistor T2 and the fourth transistor T4.

For example, because the first transistor T1 is turned on, the voltage V_C at the third node C is increased to V_dd. For example, because the second transistor T2 and the fourth transistor T4 are turned off, and the second node B is in a suspension state, the amount of the electric charges stored in the storage capacitor Cst cannot be changed suddenly, namely, the amount of the electric charges stored in the storage capacitor Cst remains unchanged. Accordingly, according to the capacitance charge conservation laws (i.e., amp-second balance), the voltage difference between two ends of the storage capacitor remains unchanged as well (namely, it is kept to be V_data+|Vth|−V_ref), and thus the voltage V_B at the second node B becomes to be V_dd−V_data−|Vth|+V_ref. For example, because the third transistor T3 is turned on, the voltage V_A at the first node A is equal to voltage V_B at the second node B, namely, V_A=V_dd−V_data−|Vth|+V_ref.

For example, the current Ids (i.e., the drive current) output from a drive transistor (i.e., the fifth transistor T5) in a saturated state may be obtained by the following computation formula:

$$\begin{aligned} Ids &= 1/2 \times K(Vgs - Vth)^2 \\ &= 1/2 \times K(Vgs + |Vth|)^2 \\ &= 1/2 \times K(\mathrm{V_A} - \mathrm{V_C} + |Vth|)^2 \\ &= 1/2 \times K(\mathrm{V_dd} - \mathrm{V_data} - |Vth| + \mathrm{V_ref} - \mathrm{V_dd} + |Vth|)^2 \\ &= 1/2 \times K(\mathrm{V_ref} - \mathrm{V_data})^2. \end{aligned}$$

where K=W/L×C×μ, W/L is the width-to-length ratio (i.e., the ratio of width to length) of the channel of the drive transistor (i.e., the fifth transistor T5), μ is electron mobility, C is capacitance per unit area.

Thus, the drive current output from the fifth transistor T5 is only relevant with the data voltage V_data and the reset voltage V_ref, but is irrelevant with the threshold voltage Vth of the fifth transistor T5. By virtue of this, the uniformity of the brightness of the display substrate and the display device including the pixel circuit 100 can be promoted.

For example, in the 5T1C circuit provided by the present embodiment, the first power supply terminal can directly charge the storage capacitor via the control circuit in a turned-on state. Because the drive voltage provided by the first power supply terminal is relatively large, charging time can be reduced.

It is to be noted that, at the display stage S3, the data voltage provided by the data source terminal Vdata can be zero, and thereby the power consumption of the pixel circuit 100 can be reduced. However, the embodiment of the present disclosure is not limited to this case. For example, at the display stage S3, the data voltage provided by the data source terminal Vdata may also be equal to the data voltage provided at the reset stage S1 and the threshold compensating stage S2 of the same display period, and thereby the drive complexity can be reduced. In the above-mentioned case, because the fourth transistor T4 is turned off, the voltage provided by the data source terminal Vdata will not be loaded to the first node A.

It is to be noted that, regarding the drive timing diagram as illustrated in FIG. 2C, the compensation function of the compensating circuit 150 has been concretely described with reference to an example in which each of the first transistor T1 to the fifth transistor T5 is a P-type transistor and the control terminal of the second transistor T2 and the control terminal of the fourth transistor T4 are connected to the same scan control terminal Scan1, but the embodiment of the present disclosure is not limited thereto.

For example, the threshold compensation is realized for the pixel circuit 100 provided by the present embodiment, and therefore the uniformity of the brightness of the display substrate and the display device including the pixel circuit 100 can be promoted.

Figure 3A:
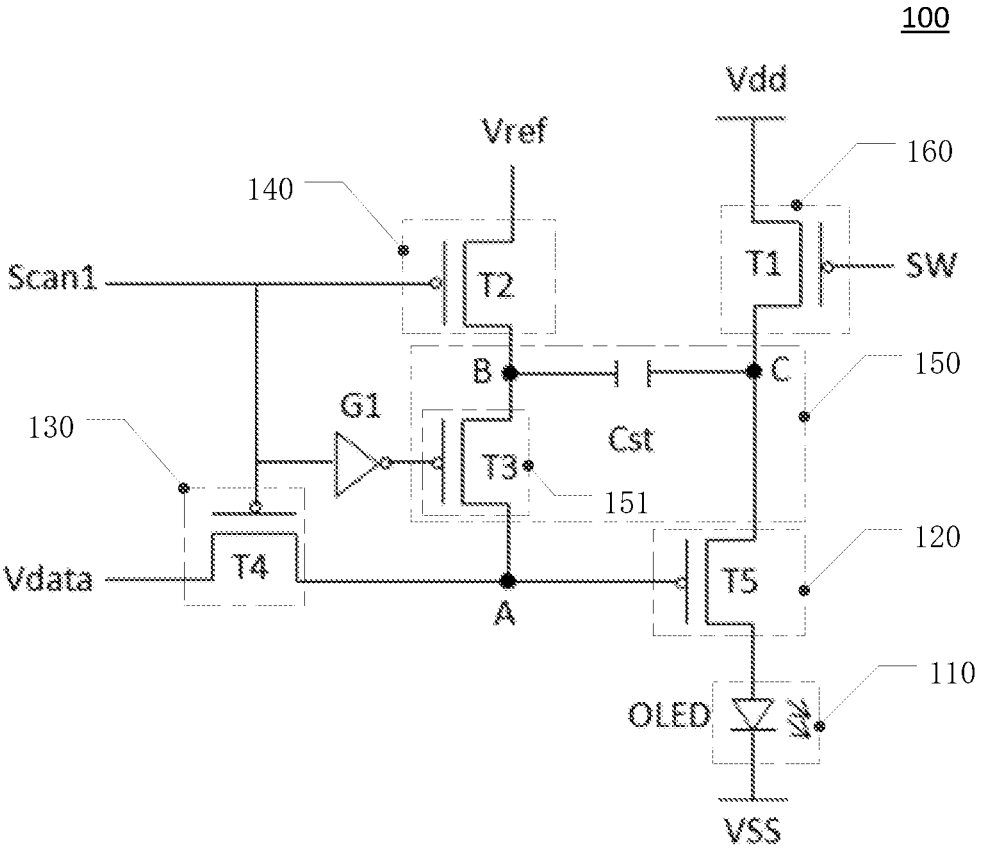
FIG. 3A is an exemplary circuit diagram illustrating another pixel circuit provided by an embodiment of the present disclosure.

An embodiment of the present disclosure provides another pixel circuit 100, which can be used in a display substrate and a display device. For example, FIG. 3A is a structurally schematic view illustrating another pixel circuit 100 provided by an embodiment of the present disclosure, and as illustrated in FIG. 3A, the pixel circuit 100 may include a light-emitting element 110, a drive element 120, a first switch circuit 130, a reset circuit 140, a compensating circuit 150 and a phase inverter G1. For example, regarding concrete implementation of the light-emitting element 110, the drive element 120, the first switch circuit 130, the reset circuit 140 and the compensating circuit 150, reference may be made to the embodiment as illustrated in FIG. 2B, and no further description will be given here. For example, all the transistors in another pixel circuit 100 provided by an embodiment of the present disclosure may be P-type transistors, but the embodiment of the present disclosure is not limited thereto.

For example, the phase inverter G1 may be arranged between the control terminal of the third transistor T3 and the scan control terminal Scan1, and the phase inverter G1 can allow a signal (i.e., the second scan signal) applied to the control terminal of the third transistor T3 and the scan signal provided by the scan control terminal Scan1 to be in the opposite states. For example, in the case where the signal provided by the scan control terminal Scan1 is a signal with high voltage level, the signal applied to the control terminal of the third transistor T3 is a signal with low voltage level; for another example, in the case where the signal provided by the scan control terminal Scan1 is a signal with low voltage level, the signal applied to the control terminal of the third transistor T3 is a signal with high voltage level. It is to be noted that, the phase inverter G1 may be a circuit including one element or a plurality of elements, and the embodiment of the present disclosure do not make specific limitation on this.

For example, the third transistor T3 may be in a state opposite to that of the second transistor T2 and the fourth transistor T4; for example, in the case where the third transistor T3 is in a turned-on state, the second transistor T2 and the fourth transistor T4 are in a turn-off state. For example, in the case where each of the second transistor T2, the third transistor T3 and the fourth transistor T4 is a P-type transistor, all of the control terminal of the second transistor T2, the control terminal of the third transistor T3 and the control terminal of the fourth transistor T4 may be connected to the same scan control terminal (i.e., the scan control terminal Scan1). By virtue of this, it may be unnecessary to arrange a second scan control terminal Scan2, and therefore, the pixel circuit 100 can be further simplified.

Figure 3B:
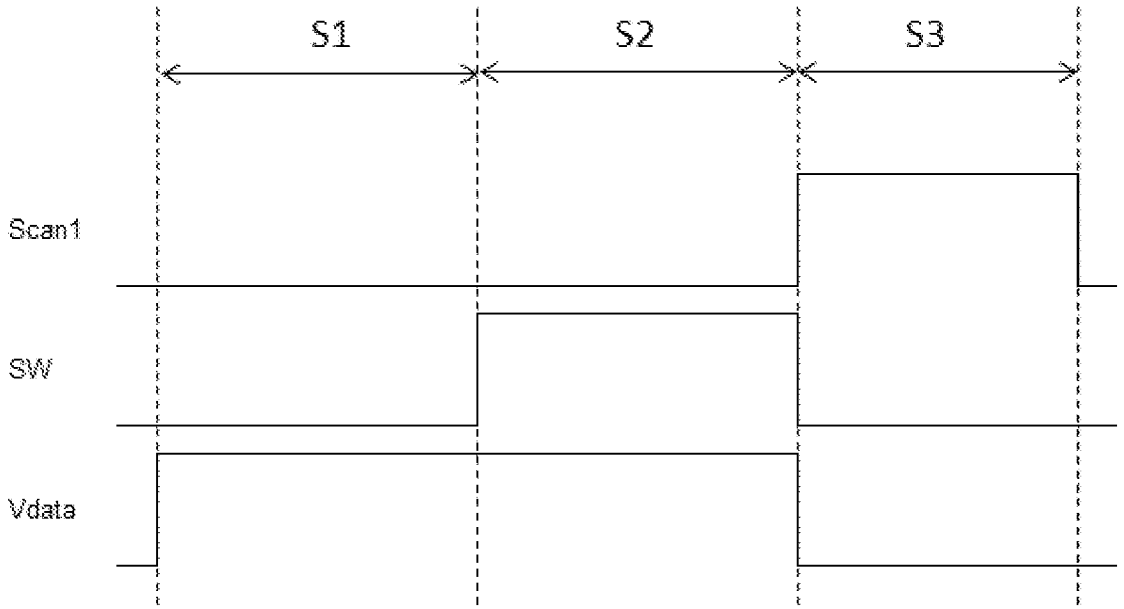
FIG. 3B is an exemplary diagram illustrating drive timing of the pixel circuit as illustrated in FIG. 3A.

For example, FIG. 3B is an exemplary drive timing diagram of the pixel circuit 100 as illustrated in FIG. 3A. For example, the operation of the pixel circuit 100 as illustrated in FIG. 3A is similar to that of pixel circuit 100 as illustrated in FIG. 2B, and the drive timing diagram as illustrated in FIG. 3B is similar to the drive timing diagram as illustrated in FIG. 2C. For example, because the phase inverter G1 is provided between the control terminal of the third transistor T3 and the scan control terminal Scan1, it is unnecessary to arrange a second scan control terminal Scan2. Therefore, as compared to the drive timing diagram as illustrated in FIG. 2C, the drive timing diagram as illustrated in FIG. 3B does not include the drive timing of the second scan control terminal Scan2. For example, regarding concrete method adopted to implement the threshold compensation function in the compensating circuit 150 of the pixel circuit 100 as illustrated in FIG. 3A, reference to the embodiment as illustrated in FIG. 2B can be made, and no further description will be given here.

For example, the drive current output from the drive element of the pixel circuit provided by the present embodiment is only relevant to the data voltage and the reset voltage, and is irrelative to the threshold voltage of the drive element; thereby the threshold compensation is achieved. Therefore, the uniformity of the brightness of the display substrate and the display device including the pixel circuit 100 can be promoted.

Figure 4A:
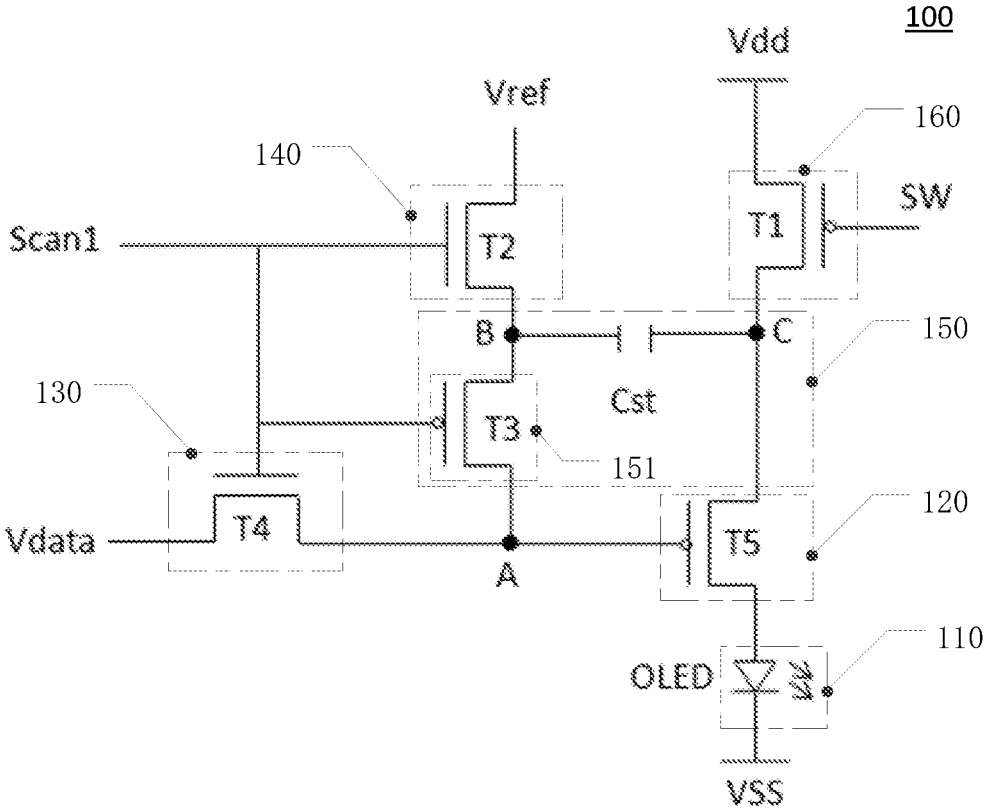
FIG. 4A is an exemplary circuit diagram illustrating still another pixel circuit provided by an embodiment of the present disclosure.

An embodiment of the present disclosure provides still another pixel circuit 100, which can be used in a display substrate and a display device. For example, FIG. 4A is a structurally schematic view illustrating still another pixel circuit 100 provided by an embodiment of the present disclosure, and as illustrated in FIG. 4A, the pixel circuit 100 may include a light-emitting element 110, a drive element 120, a first switch circuit 130, a reset circuit 140 and a compensating circuit 150. For example, the concrete implementations of the light-emitting element 110, the drive element 120, the first switch circuit 130, the reset circuit 140 and the compensating circuit 150 are similar to that of the embodiment as illustrated in FIG. 2B, and in this regard, only differences of the present embodiment with respect to the embodiment as illustrated in FIG. 2B are described in the embodiment, and no further descriptions will be given to the repeated contents.

For example, the second transistor T2 and the fourth transistor T4 in still another pixel circuit 100 provided by an embodiment of the present disclosure may be N-type transistors. For example, each of the first transistor T1, the third transistor T3 and the fifth transistor T5 may be a P-type transistor, but the embodiment of the present disclosure is not limited thereto. For example, according to actual application requirements, the first transistor T1 may also be an N-type transistor.

For example, in still another pixel circuit 100 provided by an embodiment of the present disclosure, because each of the second transistor T2 and the fourth transistor T4 is an N-type transistor, as compared to the pixel circuit 100 as illustrated in FIG. 2B, the control terminal of the second transistor T2 and the control terminal of the fourth transistor T4 are in a turned-on state and a turn-off state respectively in case of reception of a signal with high voltage level and a signal with low voltage level.

For example, the third transistor T3 may be in a state opposite to that of the second transistor T2 and the fourth transistor T4; and for example, in the case where the third transistor T3 is in a turned-on state, the second transistor T2 and the fourth transistor T4 are in a turn-off state. For example, in the case where each of the first transistor T1, the third transistor T3 and the fifth transistor T5 is a P-type transistor, and each of the second transistor T2 and the fourth transistor T4 is an N-type transistor, all of the control terminal of the second transistor T2, the control terminal of the third transistor T3 and the control terminal of the fourth transistor T4 may be connected to the same scan control terminal Scan1, and in this case, it is unnecessary to arrange a second scan control terminal Scan2. Therefore, the pixel circuit 100 can be further simplified.

Figure 4B:
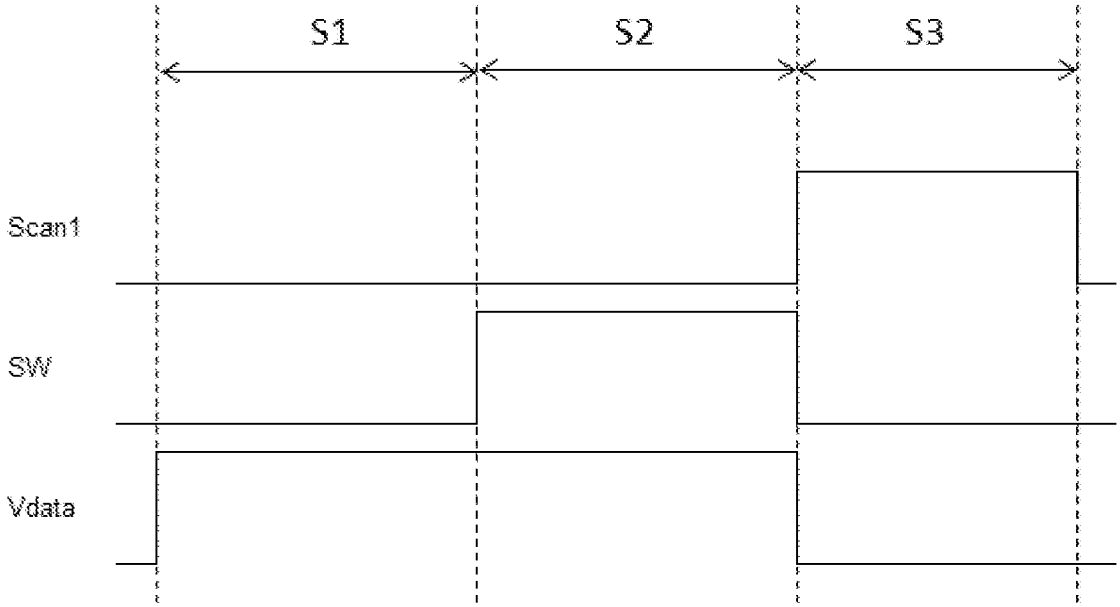
FIG. 4B is an exemplary diagram illustrating drive timing of the pixel circuit as illustrated in FIG. 4A.

For example, FIG. 4B is an exemplary drive timing diagram of the pixel circuit 100 as illustrated in FIG. 4A. For example, the operation of the pixel circuit 100 as illustrated in FIG. 4A is similar to that of the pixel circuit 100 as illustrated in FIG. 2B, and the drive timing diagram as illustrated in FIG. 4B is similar to the drive timing diagram as illustrated in FIG. 2C. Because the second transistor T2 and the fourth transistor T4 are implemented as N-type transistors, and the third transistor T3 is implemented as a P-type transistor, it is unnecessary to arrange a second scan control terminal Scan2. Therefore, as compared to the drive timing diagram as illustrated in FIG. 2C, the drive timing diagram as illustrated in FIG. 3B does not include the drive timing of the second scan control terminal Scan2. For example, regarding the concrete method adopted to implement the threshold compensation function in the compensating circuit 150 of pixel circuit 100 as illustrated in FIG. 4A, reference to the embodiment as illustrated in FIG. 2B can be made, and no further description will be given here.

Figure 4C:
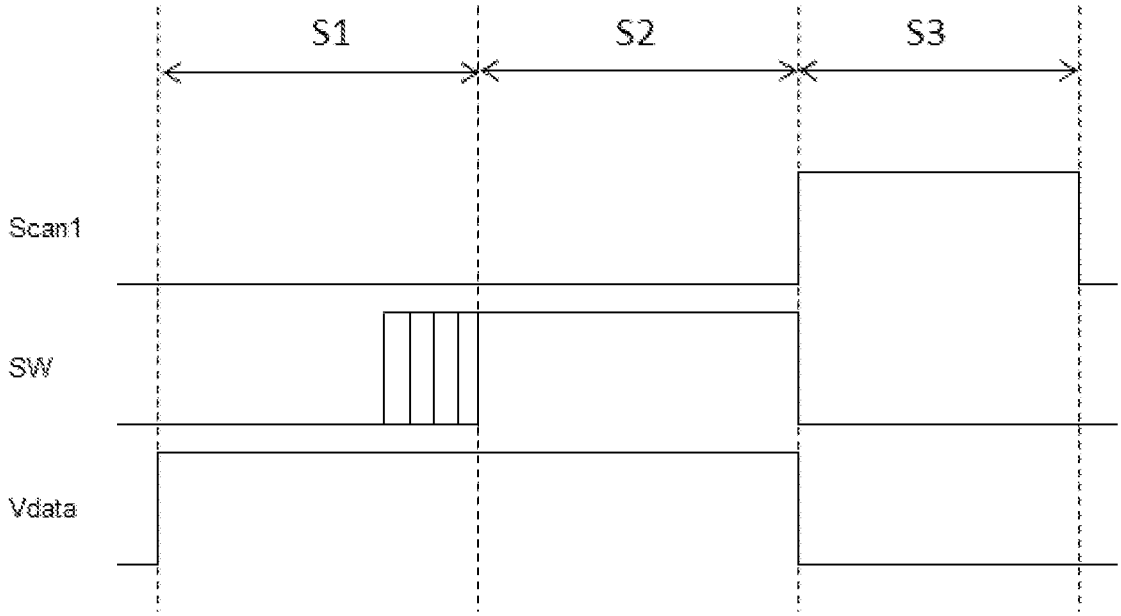
FIG. 4C is another exemplary diagram illustrating drive timing of the pixel circuit as illustrated in FIG. 4A.

For example, FIG. 4C is another exemplary drive timing diagram of the pixel circuit 100 as illustrated in FIG. 4A. For example, the drive timing diagram as illustrated in FIG. 4C is similar to the drive timing diagram as illustrated in FIG. 4B. For example, as compared to the drive timing diagram as illustrated in FIG. 4B, in the drive timing diagram as illustrated in FIG. 4C, the drive voltage control terminal SW may firstly provide an on-signal (e.g., signal with low voltage level) to the control terminal of the first transistor T1 for a pre-determined time length, and then provide an off-signal (e.g., signal with high voltage level) to the control terminal of the first transistor T1. In this case, the first transistor T1 is in a turned-on state only within partial time of the reset stage S1, and thus charging of the storage capacitor Cst can be stopped before the voltage at the second end (i.e., third node C) of the storage capacitor Cst is increased to the drive voltage V_dd. This allows the voltage at the third node C to be smaller than the drive voltage V_dd and greater than V_data+|Vth| at the end of the reset stage S1, and thus the discharging time of the fifth transistor T5 at the threshold compensating stage S2 can be shortened. Therefore, the display effect of the display substrate and the display device including the pixel circuit 100 can be promoted.

It is to be noted that, in the drive timing diagrams as illustrated in FIG. 2C and FIG. 3C, at the reset stage S1, the drive voltage control terminal SW firstly can also firstly provide an on-signal (e.g., signal with low voltage level) to the control terminal of the first transistor T1, and then provide an off-signal (e.g., signal with high voltage level) to the control terminal of the first transistor T1, and therefore the display effect of the display substrate and the display device including the pixel circuit as illustrated in FIG. 2B or/and FIG. 3A can be promoted.

For example, as for the drive timing diagram as illustrated in FIG. 4C, the time length of the signal for turning on the first transistor T1 that is provided by the drive voltage control terminal SW to the control terminal of the first transistor T1 at the reset stage S1 may be obtained through experiment measurement, namely, the time length of the signal with low voltage level in the stage S1 can be controlled. However, the embodiment of the present disclosure is not limited to this case.

For example, the drive current output from the drive element of the pixel circuit provided by the present embodiment is only relevant to the data voltage and the reset voltage, and is irrelative to the threshold voltage of the drive element, thereby realizing threshold compensation. Therefore, the uniformity of the brightness of the display substrate and the display device including the pixel circuit can be promoted.

For the pixel circuit according to embodiments of the present disclosure, other component may further be added as required. For example, between the light-emitting element and the drive circuit, a light-emitting control circuit may be arranged, the first terminal of the light-emitting control circuit is connected to the drive circuit, the second terminal of the light-emitting control circuit is connected to the light-emitting element, while the control terminal of the light-emitting control circuit is configured to receive a light-emitting control signal. By virtue of this, the light-emitting element can be disconnected from or connected with the drive circuit as required, so as to avoid the light emitting of the light-emitting element in unnecessary situations. In this way, the contrast ratio of the display device adopting the pixel circuit is enhanced, and the energy consumption is reduced. The light-emitting control circuit is, for example, a switching circuit; for example, the switching circuit is a transistor, and it may be an N-type transistor or a P-type transistor.

Figure 5:
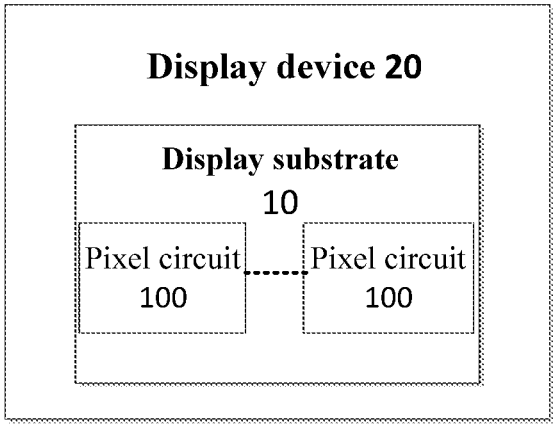
FIG. 5 is a schematic block diagram illustrating a display substrate and a display device provided by another embodiment of the present disclosure.

At least an embodiment of the present disclosure provides a display substrate and a display device, the display substrate includes the pixel circuit provided by any embodiment of the present disclosure; the display device includes the pixel circuit or the display substrate provided by any embodiment of the present disclosure. Hereinafter, the display substrate and the display device according to the embodiment of the present disclosure will be described with reference to the embodiment as illustrated in FIG. 5, but the embodiment of the present disclosure is not limited to the display substrate and the display device provided by the embodiment as illustrated in FIG. 5.

Another embodiment of the present disclosure provides a display substrate 10. For example, as illustrated in FIG. 5, the display substrate 10 may include a plurality of pixel circuits which may be the pixel circuits 100 provided by any embodiment of the present disclosure. The plurality of pixel circuits may be arranged in arrays, but the embodiment of the present disclosure is not limited thereto.

For example, the display substrate may further include a plurality of scan signal lines (e.g., gate lines) and a plurality of data lines that are intersected with (e.g., be perpendicular to) each other, and a plurality of voltage control lines disposed in parallel to the scan signal lines. For example, each of the pixel circuits is connected to a corresponding scan signal line and a corresponding data line, and for example, for each of pixel circuits, the scan control terminal may be connected to a corresponding scan signal line, the data source terminal may be connected to a corresponding data line, and the voltage control terminal may be connected to a corresponding voltage control line. For example, in the case where the plurality of pixel circuits are arranged in an arrays, the pixel circuits located in each row of the pixel circuit array may be connected to the same scan signal line, the pixel circuits located in each row of the pixel circuit array may be connected to the same voltage control line, and the pixel circuits located in each column of the pixel circuit array may be connected to the same data line. However, the embodiment of the present disclosure is not limited to this case.

For example, the present embodiment further provides a display device 20. For example, as illustrated in FIG. 5, the display device 20 may include the pixel circuit 100 provided by any embodiment of the present disclosure or the display substrate 10 provided by any embodiment of the present disclosure.

It should be noted that other components (for example, the control device of a thin film transistor, an image data encoding/decoding device, a row scan driver, a column scan driver, a clock circuit and so on) of the display substrate 10 and the display device 20 may adopt conventional suitable components, this should be understood by those skilled in the art, no further descriptions will be given herein and it should not be construed as a limitation on the embodiments of the present disclosure.

Threshold compensation can be realized for the display substrate and the display device provided by the present embodiment, and therefore the uniformity of the brightness of the display substrate and the display device can be promoted.

Figure 6:
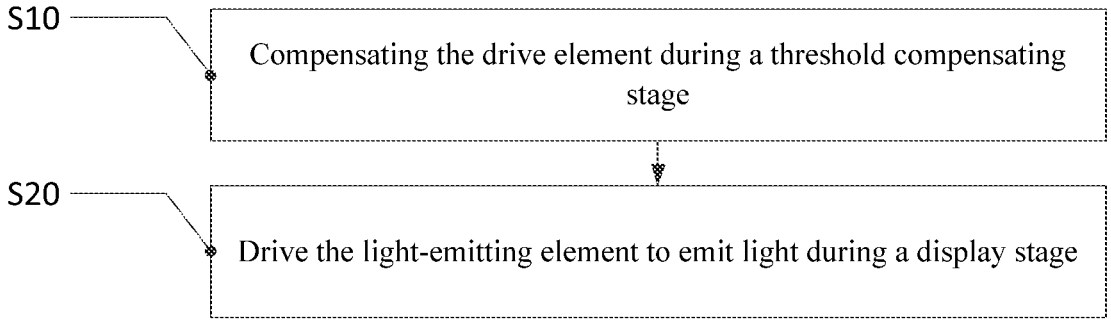
FIG. 6 is an exemplary flowchart illustrating a driving method of a pixel circuit provided by still another embodiment of the present disclosure.

At least an embodiment of the present disclosure further provides a driving method of a pixel circuit, the driving method includes: compensating a drive element at a threshold compensating stage, and driving a light-emitting element to emit light by the drive element, in which the luminance of the light-emitting element is irrelative to the threshold characteristic of the drive element. The driving method of the pixel circuit according to embodiments of the present disclosure will be described below with reference to the embodiment as illustrated in FIG. 6, but the embodiment of the present disclosure is not limited to the driving method provided by the embodiment as illustrated in FIG. 6.

Further another embodiment of the present disclosure provides a driving method of a pixel circuit, which may be used to drive the pixel circuit provided by any embodiment of the present disclosure. For example, FIG. 6 is an exemplary flowchart illustrating the driving method of the pixel circuit. For example, as illustrated in FIG. 6, the driving method of the pixel circuit may include the following steps.

Step S10, compensating a drive element with a compensating circuit at a threshold compensating stage.

Step S20, driving a light-emitting element by the drive element to emit light at a display stage.

For example, the driving method may further include a step S30, namely, at a reset stage, applying a data voltage to the drive element, and applying a reset signal to the compensating circuit with the reset circuit.

For example, in the step S10, namely, at the threshold compensating stage, an electric signal including the data voltage, a reset voltage and a threshold voltage may be applied to the storage capacitor of the compensating circuit, and thereby compensation of the drive element can be realized.

For example, in the step S20, namely, at the display stage, the light-emitting element is driven by the drive element to emit light. Because the electric signal including the data voltage, the reset voltage and the threshold voltage can be transferred from the storage capacitor of the compensating circuit to the control terminal of the drive element at the display stage, the signal output from the drive element and the luminance of the light-emitting element can be irrelative to the threshold characteristic of the drive element.

For example, the driving method of the pixel circuit may be executed in the order of step S30, step S10 and step S20, but the embodiment of the present disclosure is not limited thereto. For example, regarding concrete implementing method of the step S10, step S20 and step S30, reference to embodiments as illustrated in FIG. 2B, FIG. 3A and FIG. 4A can be made, and no further description will be given here.

For example, threshold compensation can be realized for the driving method of the pixel circuit provided by the present embodiment, and therefore the uniformity of the brightness of the display substrate and the display device including the pixel circuit can be promoted.

It is apparent that the presented disclosure may be changed and modified by those skilled in the art without departure from the spirit and scope of the disclosure, if the above-mentioned changes and modifications of the presented disclosure belong to the scope of the claims of the presented disclosure and its equivalent technologies, the presented disclosure is intended to include the above-mentioned changes and modifications.

What are described above is relevant with the illustrative embodiments of the disclosure only and not limitative to the scope of the disclosure; the scopes of the disclosure are defined by the accompanying claims.

What is claimed is:

1. A driving method of a pixel circuit, wherein the pixel circuit comprises a light-emitting element, a drive element, a first switch circuit, a reset circuit, a compensating circuit, and a control circuit, the drive element is connected to the light-emitting element and configured to drive the light-emitting element to emit light;

the first switch circuit is configured to apply a data voltage to the drive element under control of a scan signal;

the reset circuit is connected to the compensating circuit and configured to apply a reset signal to the compensating circuit under control of the scan signal;

the compensating circuit is configured to compensate the drive element, so as to allow a signal output from the drive element to be irrelative to a threshold characteristic of the drive element; and the control circuit is connected to the drive element and the compensating circuit, and configured to apply a drive signal to the drive element and the compensating circuit based on a control signal, wherein the driving method comprises:

applying the data voltage to the drive element, and applying, by the reset circuit, the reset signal to the compensating circuit, at a reset stage, and applying the drive signal to the drive element and a first end of a storage capacitor in the compensating circuit within a partial time of the reset stage, wherein the first end of the storage capacitor in the compensating circuit is charged to a voltage lower than a voltage of the drive signal at end of the reset stage;

compensating the drive element with the compensating circuit at a threshold compensating stage; and outputting, by the drive element, a signal so as to drive the light-emitting element to emit light at a display stage, wherein the signal output from the drive element is irrelative to the threshold characteristic of the drive element.

2. The driving method according to claim 1, wherein the reset signal is a reset voltage;

the signal output from the drive element is a drive current; and the compensating circuit is further configured to allow the signal output from the drive element to be relevant with the data voltage and the reset signal.

3. The driving method according to claim 1, wherein the control circuit comprises a first transistor;

a control terminal of the first transistor is configured to receive the control signal;

a first terminal of the first transistor is configured to receive the drive signal; and a second terminal of the first transistor is connected to a first node.

4. The driving method according to claim 3, wherein the compensating circuit comprises the storage capacitor and a second switch circuit; and the second switch circuit is configured to control whether or not the storage capacitor is connected to a control terminal of the drive element based on a second scan signal.

5. The driving method according to claim 4, wherein the first end of the storage capacitor is connected to the first node, and a second end of the storage capacitor is connected to a second node; and the second switch circuit comprises a second transistor, a control terminal of the second transistor is configured to receive the second scan signal, a first terminal of the second transistor is connected to the second node, and a second terminal of the second transistor is connected to a third node.

6. The driving method according to claim 5, wherein the reset circuit comprises a third transistor;

a control terminal of the third transistor is configured to receive the scan signal;

a first terminal of the third transistor is configured to receive the reset signal; and a second terminal of the third transistor is connected to the second node.

7. The driving method according to claim 6, wherein the first switch circuit comprises a fourth transistor, a control terminal of the fourth transistor is configured to receive the scan signal, a first terminal of the fourth transistor is configured to receive the data voltage, and a second terminal of the fourth transistor is connected to the third node; and the drive element comprises a fifth transistor, a control terminal of the fifth transistor is configured to be the control terminal of the drive element, and configured to be connected to the third node, the data voltage is applied to the control terminal of the drive element, a first terminal of the fifth transistor is connected to the first node, and a second terminal of the fifth transistor is connected to a first terminal of the light-emitting element.

8. The driving method according to claim 7, wherein the light-emitting element is an organic light-emitting element, and a second terminal of the light-emitting element is connected to a first power supply terminal.

9. The driving method according to claim 7, wherein the first transistor, the second transistor, and the fifth transistor are P-type transistors.

10. The driving method according to claim 7, wherein the third transistor and the fourth transistor are N-type transistors; and the control terminals of the second transistor, the third transistor and the fourth transistor are connected to a same one scan control terminal.

11. The driving method according to claim 7, wherein the pixel circuit further comprises a phase inverter, the phase inverter is arranged between the control terminal of the second transistor and a scan control terminal;

the third transistor and the fourth transistor are P-type transistors; and the control terminals of the second transistor, the third transistor, and the fourth transistor are connected to a same one scan control terminal.

* * * * *